United States Patent [19]

Nakamura

[11] Patent Number: 4,463,714

[45] Date of Patent: Aug. 7, 1984

[54] HYDRAULIC LIFTER

[75] Inventor: Makoto Nakamura, Yokohama, Japan

[73] Assignee: Nissan Motor Company, Limited, Yokohama, Japan

[21] Appl. No.: 412,100

[22] Filed: Aug. 27, 1982

[30] Foreign Application Priority Data

Oct. 8, 1981 [JP] Japan ..... 56-160603

[51] Int. Cl.[3] ..... F01L 1/24; F01L 1/02

[52] U.S. Cl. ..... 123/90.57; 123/90.46; 123/90.55; 123/90.52

[58] Field of Search ..... 123/90.56, 90.36, 90.46, 123/90.48, 90.52, 90.55, 90.57

[56] References Cited

U.S. PATENT DOCUMENTS

| | | | |
|---|---|---|---|
| 3,140,698 | 7/1964 | Voorhies | 123/90.46 |
| 3,177,857 | 4/1965 | Kuchen et al. | 123/90.55 |
| 3,799,129 | 3/1974 | Cornell | 123/90.46 |
| 4,184,464 | 1/1980 | Svihlik | 123/90.57 |
| 4,227,495 | 10/1980 | Krieg | 123/90.55 |
| 4,228,771 | 10/1980 | Krieg | 123/90.55 |

FOREIGN PATENT DOCUMENTS

| | | | |
|---|---|---|---|
| 2010562 | 9/1971 | Fed. Rep. of Germany | 123/90.57 |
| 1379878 | 1/1975 | United Kingdom . | |
| 1414429 | 11/1975 | United Kingdom . | |
| 1476357 | 6/1977 | United Kingdom . | |

*Primary Examiner*—Craig R. Feinberg
*Assistant Examiner*—David A. Okonsky
*Attorney, Agent, or Firm*—Leydig, Voit, Osann, Mayer and Holt, Ltd.

[57] ABSTRACT

A hydraulic lifter has an upper plunger member and a lower plunger member slidably received in a bore of a casing. A reservoir chamber is formed in the upper and lower plunger members for receiving hydraulic fluid, and a pressure chamber is formed between a blind bottom end of the casing and the bottom of the lower plunger. Both chambers are fluidly connected through a check valve. In order to vent air in the reservoir chamber and thereby to prevent air from entering the pressure chamber, there is formed in the upper plunger member at least one air vent hole located above a fluid inlet of the reservoir chamber. There is further formed a fluid passage between the upper plunger and the lower plunger for allowing fluid in the clearance between the casing and the plunger members to return to the reservoir chamber. This fluid passage may comprises a plurality of radially extending grooves formed either in the face of the bottom end of the upper plunger or in the face of the top end of the lower plunger.

4 Claims, 6 Drawing Figures

HYDRAULIC LIFTER

BACKGROUND OF THE INVENTION

The present invention relates to a hydraulic lifter or clearance adjuster for use in a valve operating mechanism of an internal combustion engine.

A hydraulic lifter takes up all clearance in the valve train all the time during engine operation, and absorbs thermal expansion of the valve stem or other members by changing the length of the lifter itself. If, however, air is contained in hydraulic fluid and introduced into the hydraulic lifter together with the hydraulic fluid, the hydraulic lifter cannot correctly perform its function and cannot maintain quiet operation any more. Besides, a plunger of the hydraulic lifter must be held not only easily slidable axially but also it must be easily rotatable on its own axis in order to prevent uneven wear of contacting parts.

SUMMARY OF THE INVENTION

It is, therefore, an object of the present invention to provide a hydraulic lifter or clearance adjuster having means for efficiently venting air brought into the hydraulic lifter.

It is another object of the present invention to provide a hydraulic lifter in which a plunger is held easily rotatable on its own axis.

According to the present invention, the hydraulic lifter or clearance adjuster comprises a casing having a bore formed therein with the bottom end being blind and a fluid passage for receiving hydraulic fluid, and a plunger means which is slidably received in the bore of the casing and comprises a hollow upper plunger member having a top end projecting from the casing, an open bottom end, a fluid inlet hole communicating the fluid passage of the casing with the interior cavity of the upper plunger member, and an air vent hole located above the fluid inlet hole, and a hollow lower plunger member having an open top end abutting against the open bottom end of the upper plunger thereby defining a reservoir chamber formed by the interior cavities of the upper plunger and lower plunger members for receiving hydraulic fluid introduced through the fluid passage of the casing and the fluid inlet hole of the upper plunger member, and a bottom end defining a pressure chamber formed between the bottom end of the lower plunger member and the blind bottom end of the bore of the casing and being formed with a feed hole communicating the reservoir chamber with the pressure chamber. The hydraulic lifter or clearance adjuster according to the present invention further comprises a check valve provided in the feed hole formed in the bottom end of the lower plunger for permitting fluid flow only in one direction from the reservoir chamber to the pressure chamber, and means for biasing the plunger means outwardly of the cavity of the casing.

Preferably, the plunger means has a fluid passage formed between the bottom end of the upper plunger member and the top end of the lower plunger member for fluidly communicating the reservoir chamber with the clearance space between the casing and the plunger means. This fluid passage of the plunger means may comprise at least one groove formed in the bottom end face of the upper plunger member or in the top end face of the lower plunger member and extending radially, and an annular groove formed in the outer periphery of either the bottom end face of the upper plunger member or the top end face of the lower plunger member.

BRIEF DESCRIPTION OF THE DRAWINGS

FIG. 5 is a sectional view of the hydraulic lifter according to the present invention applied to a valve operating mechanism having a push rod.

DETAILED DESCRIPTION OF THE INVENTION

To facilitate understanding the present invention, a brief reference will be made to a conventional type hydraulic lifter as disclosed in U.S. Pat. No. 4,228,771, which is shown in FIG. 2.

Figure 1:
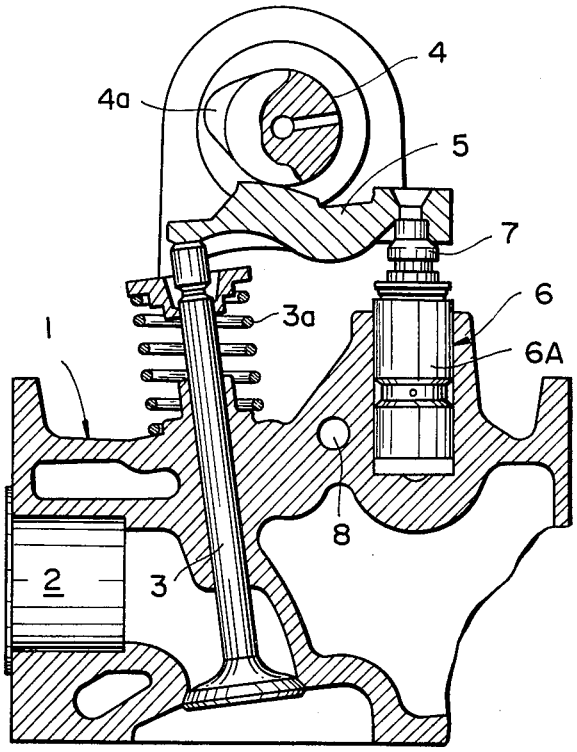
FIG.1 PRIOR ART
FIG. 1 is a sectional view of a valve operating mechanism of one type.
Figure 2:
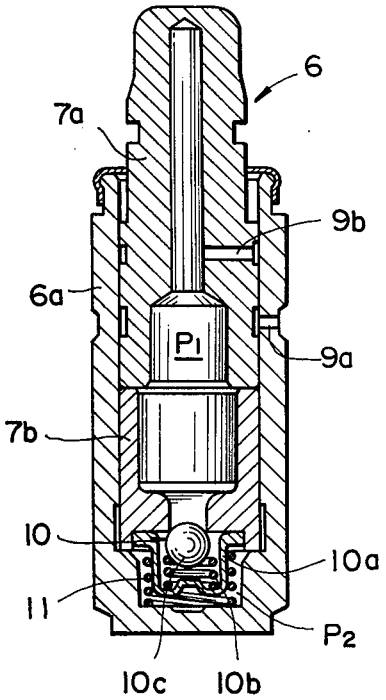
FIG.2 PRIOR ART
FIG. 2 is a sectional view of a hydraulic lifter of a conventional type.

In FIGS. 1 and 2, a cylinder head 1 is formed with an intake (or exhaust) port 2 and provided with an intake (or exhaust) valve 3.

A valve operating mechanism for the intake (or exhaust) valve includes a camshaft 4 which rotates in connection with the engine, and a rocker arm 5. With this valve operating mechanism, the intake (or exhaust) valve 3 is opened and closed in synchronization with the rotation of the engine.

In order to adjust valve clearance or lash of the intake (or exhaust) valve 3, there is provided a hydraulic lifter 6 which serves as a fulcrum of the rocker arm 5. A casing 6A of the hydraulic lifter 6 is retained in the cylinder head 1 with a screw or the like.

As shown in FIG. 2, the hydraulic lifter 6 has an upper plunger member 7*a* and a lower plunger member 7*b* which are slidably contained in a bore of the casing 6*a*. The top of the upper plunger member 7*a* abuts against an end portion of the rocker arm 5.

From an oil gallery 8 (as seen in FIG. 1) formed in the cylinder head 1, engine oil is introduced through oil passages 9*a*, 9*b* formed, respectively, in the casing 6*a* and the upper plunger member 7*a* into a reservoir chamber P1 formed within the upper and lower plunger members 7*a* and 7*b*. The oil in the reservoir chamber P1 can flow down through a check valve 10 disposed in the bottom of the lower plunger member 7*b* into a pressure chamber P2 formed by the bottom of the lower plunger 7*b* and the interior bottom of the casing 6*a*.

The check valve 10 comprises a cage 10*a* provided in the bottom of the lower plunger member 7*b*, and a movable member or check ball 10*c* which is movably received in the cage 10*a* and always urged to a closed position toward the reservoir chamber by a coil spring 10*b* provided within the cage 10*a*. Thus, the check valve 10 prevents a return flow of oil from the pressure chamber P2 to the reservoir chamber P1.

There is further provided, within the pressure chamber P2, a coil spring 11 which always urges the upper plunger member 7*a* and the lower plunger member 7*b* upward. The bias force of the coil spring 11 is set as being lower than that of the valve spring 3*a* of the intake (or exhaust) valve 3.

When the cam 4a of the cam shaft 4 is out of contact with the rocker arm 5 and instead the base circle portion is in contact with the rocker arm 5, no load is present on the top end of the upper plunger member 7a. In this state, the bias force of the coil spring 11 in the pressure chamber P2 and the pressure of the oil in the pressure chamber P2 push up the upper and lower plunger members 7a and 7b. By so doing, the valve lifter 6 pushes up the fulcrum portion of the rocker arm 5 and thus takes up the valve clearance between the other end portion of the rocker arm 5 and the top end of the intake (or exhaust) valve 3.

When, on the other hand, the cam 4a pushes down the rocker arm 5, the pressure applied on the top end of the upper plunger member 7a pushes down the upper and lower plunger members 7a and 7b. In this case, the check valve 10 prevents the oil in the pressure chamber P2 from flowing into the reservoir chamber P1, so that the oil is confined within the pressure chamber P2. As a result, the upper and lower plunger members 7a and 7b can not move downward against the oil pressure in the pressure chamber P2 and therefore remain stationary. Accordingly, the rocket arm 5 swings on the fulcrum at the top end of the upper plunger member 7a and pushes down, with the other end portion, the intake (or exhaust) valve 3 to open it.

Thus, the hydraulic lifter 6 automatically always takes up the valve clearance during engine operation. Furthermore, dimensional changes of the intake (or exhaust) valve 3 or other members caused by temperature changes are absorbed by axial displacements of the upper and lower plunger members 7a and 7b. Therefore, the hydraulic lifter prevents noises during operations of the intake (or exhaust) valve or other members, and at the same time ensures that the intake (or exhaust) valve 3 is correctly opened and closed.

In this hydraulic lifter, the oil passage 9b formed in the upper plunger 7a is also used as an air vent. However, air contained in the oil supplied from the oil gallery 8 is not removed enough during oil flow through the passages 9a and 9b but is introduced into the reservoir chamber P1 together with the oil. Consequently, the hydraulic lifter becomes unable to take up the valve clearance, and the upper and lower plunger members 7a and 7b move up and down voilently, so that noises are produced between adjoining members, and the wear of the upper and lower plunger members 7a and 7b is promoted.

Furthermore, the bottom surface of the upper plunger member 7a is in contact with the top surface of the lower plunger member 7b in their entire circumferences, so that a relative rotation between the upper plunger 7a and the lower plunger 7b is made difficult. This is disadvantageous, especially when the upper plunger which abuts against the rocker arm can not rotate well, in that the outer wall of the upper plunger is subjected to eccentric wear.

Figure 3:
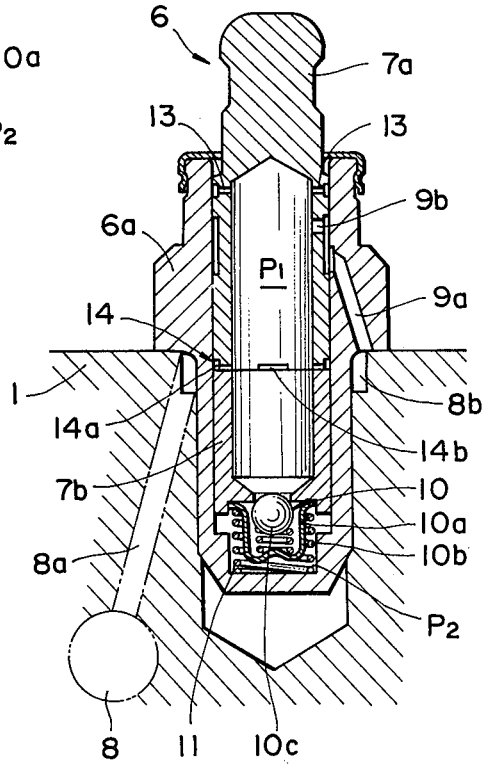
FIG. 3 is a sectional view of the hydraulic lifter according to the present invention.

In view of the above description, a reference is now made to FIG. 3, wherein one embodiment of the present invention is shown.

As shown in FIG. 3, an oil passage 9a is formed through the wall of a casing 6a, and this oil passage 9a communicates with the oil gallery 8 through a passage 8a and an annular passage 8b. An oil passage 9b is formed through the wall of the upper plunger member 7a and communicates with the oil passage 9a for introducing oil into the reservoir chamber P1.

There are further formed in the upper plunger 7a a plurality of air vent passages 13 which extend through the wall of the upper plunger members 7a on a level higher than the oil passage 9b. Air in the reservoir chamber P1 can escape through the air vent passages 13 into a space between the sliding contact faces of the upper plunger member 7a and the casing 6a, and then vent to the outside.

In the abutting portion of either the upper plunger 7a or the lower plunger 7b, there is formed an oil passage 14 which communicates the clearance space between the casing 6a and the upper and lower plunger members 7a and 7b with the reservoir chamber P1. Through this oil passage 14, oil which leaks into the clearance space returns into the reservoir chamber P1.

This oil passage 14 consists of an annular groove 14a and a plurality of radial grooves 14b which are both formed in the bottom face of the upper plunger member 7a (or the top face of the lower plunger member 7b). The annular groove 14a encircles the outer periphery of the upper plunger (or the lower plunger), and the radial grooves communicate with the annular groove 14a and extend radially.

The upper and lower plunger members 7a and 7b may be fabricated by cold forging process, respectively, and the annular groove 14a and the radial grooves 14b are also formed during this working process and finished by a machining process. The oil passage 9b and the air vent passages 13 are formed in the upper plunger member 7a by drilling or other method after the cold forging process of the upper plunger 7a.

In other respects, the construction of the hydraulic lifter shown in FIG. 3 is the same as that of FIG. 2, so that the same reference numerals as used in FIGS. 1 and 2 are used to denote the same or equivalent parts and, for brevity are not described again.

With this arrangement, oil discharged from an engine lubricating oil pump under pressure flows through the oil gallery 8 and the oil passages 8a and 8b in the cylinder head 1, and then enters the reservoir chamber P1 through the passage 9a formed in the casing 6a of the hydraulic lifter 6 and the passage 9b formed in the upper plunger member 7a in fluid communication with the passage 9a.

In this case, air contained in the oil flowing into the reservoir chamber P1 can efficiently vent out of the reservoir chamber P1 through the air vent passages 13 located above the oil inlet passage 9b. In the case of the hydraulic lifter shown in FIG. 2, air bubbles must vent through the oil inlet passage 9b, so that air bubbles are forced back by the incoming oil flow. In the case of the lifter of FIG. 3 according to the present invention, air bubbles can smoothly vent out through the vent passage 13 without being disturbed by the oil flow.

Accordingly, there is almost no air within the oil which enters the pressure chamber P2 from the reservoir chamber P1 through the check valve 10 when a downward force is not applied from the camshaft 4.

Because there is almost no air in the pressure chamber P2, a pressure decrease is not caused by a compression of the air. Therefore, when a downward force is applied to the upper and lower plunger members 7a and 7b by the camshaft 4 to open the valve 3, the pressure chamber P2 is hydraulically locked without a pressure decrease due to air, and reliably holds the upper and lower plunger members 7a and 7b stationary. As a result, the hydraulic lifter according to the present invention can significantly reduce mechanical noise by preventing knocking between the rocker arm 5 and the cam 4*a* or other pairs of adjoining members.

While a downward force is applied to the upper and lower plunger members 7*a* and 7*b*, a moment of rotation of the rocker arm 5 pushes the upper and lower plunger members 7*a* and 7*b* toward one side against the wall of the casing 6*a*, and tends to cause an one sided wear of the upper and lower plunger members 7*a* and 7*b*. In the case of the hydraulic lifter of FIG. 3, the influence of the rotation moment of the rocker arm 5 is not exerted directly on the lower plunger member 7*b*, and an oil which leaks from the pressure chamber P2 into the clearance space between the casing 6*a* and the upper and lower plungers 7*a* and 7*b* can return to the reservoir chamber P1 through the passage 14, so that a satisfactory lubrication is provided for the contacting faces. Furthermore, formation of the annular groove 14*a* and the radial grooves 14*b* reduces the area of the contacting surfaces between the upper plunger member 7*a* and the lower plunger member 7*b*. All these features ensure a smooth rotation of the upper plunger 7*a* on its own axis and smooth up and down movements of the upper and lower plunger members 7*a* and 7*b*.

Figure 4:
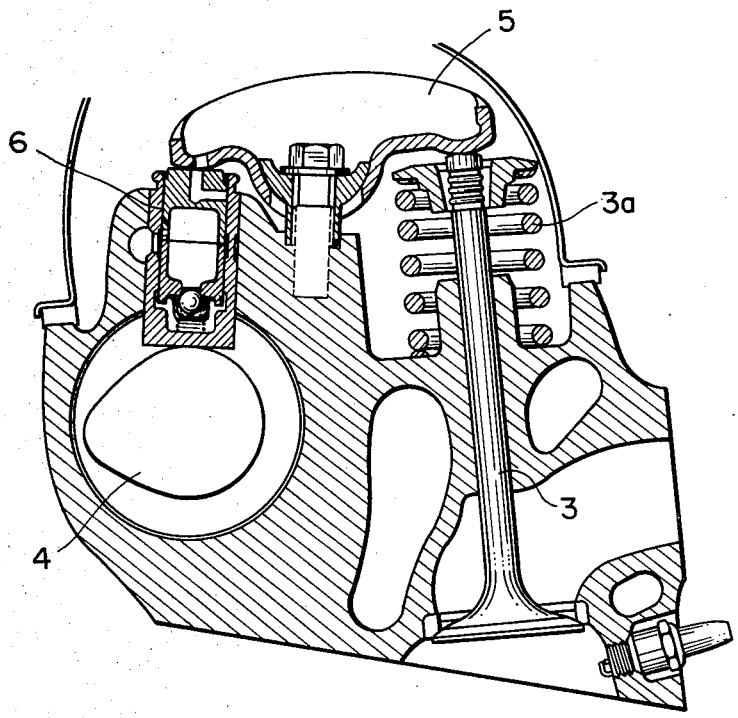
FIG. 4 is a sectional view of a valve operating mechanism of another type.
Figure 5:
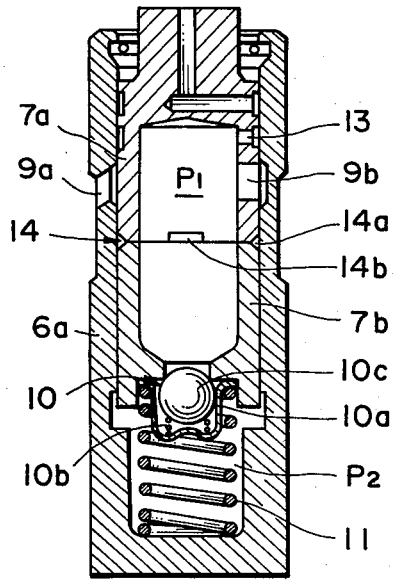
FIG. 5 is a sectional view of the hydraulic lifter applied to the valve operating mechanism of FIG. 4.
Figure 6:
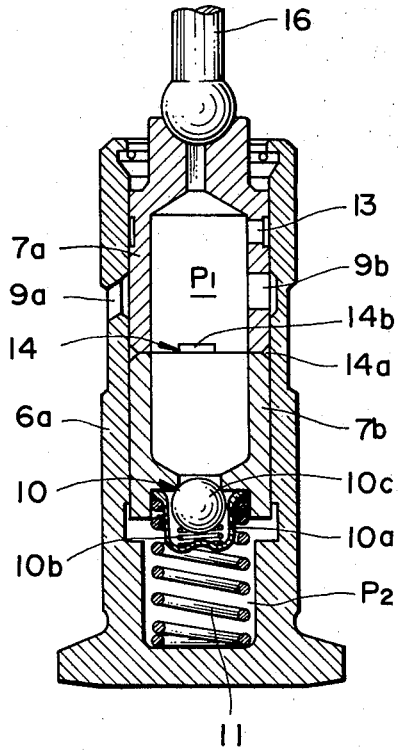

Although the hydraulic lifter of the present invention has been described as employed in the valve operating mechanism shown FIG. 1, it will be appreciated that the hydraulic lifter of the present invention may also be employed in other types of valve operating arrangements. For example, an overhead cam center pivoted rocker arm type valve operating arrangement is shown in FIG. 4. FIG. 5 shows the hydraulic lifter according to the present invention to be applied to the valve operating arrangement of FIG. 4. FIG. 6 shows the hydraulic lifter according to the present invention applied to a valve operating mechanism having a push rod. In FIG. 6, the hydraulic lifter pushes up a push rod 16. The constructions of these hydraulic lifters shown in FIGS. 5 and 6 are almost the same as the construction shown in FIG. 3. In FIGS. 5 and 6, too, there are formed, in an upper plunger 7*a*, at least one air vent passage 13 located above a fluid inlet hole 9*b*, and an oil passage 14 for communicating the clearance space between a casing 6*a* and the upper and lower plunger members 7*a*, 7*b* with a reservoir chamber P1.

What is claimed is:

1. A hydraulic clearance adjuster for a valve gear of an internal combustion engine, comprising:

a casing having a bore formed therein with a blind bottom end and a fluid passage for receiving hydraulic fluid;

plunger means slidably received in said bore of said casing, said plunger means comprising:

a hollow upper plunger member defining a first interior cavity therein and having a top end projecting from said casing, an open bottom end, a fluid inlet hole communicating said fluid passage of said casing with the interior cavity of said upper plunger member and at least one air vent hole in said upper plunger member in fluid communication with said first interior cavity which at least one air vent hole is located above said fluid inlet hole and which opens into a clearance space formed between said casing and said upper plunger member, and a hollow lower plunger member defining a second interior cavity therein and having an open top end abutting against the open bottom end of said upper plunger member thereby defining a reservoir chamber formed by said first and second interior cavities of said upper and lower plunger members for receiving hydraulic fluid introduced through said fluid passage of said casing and said fluid inlet hole of said upper plunger member, and a bottom end defining a pressure chamber formed between the blind bottom end of said bore of said casing and the bottom end of said lower plunger member and being formed with a feed hole communicating said reservoir chamber with said pressure chamber;

a check valve provided in said feed hole for permitting fluid flow from said reservoir chamber to said pressure chamber and preventing return flow; and means for biasing said plunger means outwardly of said cavity.

2. The hydraulic clearance adjuster according to claim 1, wherein said plunger means has a fluid passage formed between the bottom end of said upper plunger member and the top end of said lower plunger member for fluidly communicating said reservoir chamber with the clearance space between said casing and said plunger means.

3. The hydraulic clearance adjuster according to claim 2, wherein said fluid passage of said plunger means comprises at least one groove formed in the bottom end face of said upper plunger member and extending radially, and an annular groove formed in the outer periphery of the bottom end face of said upper plunger member.

4. The hydralic clearance adjuster according to claim 2, wherein said fluid passage of said plunger means comprises at least one groove formed in the top end face of said lower plunger member and extending radially, and an annular groove formed in the outer periphery of the top end face of said lower plunger member.

* * * * *